US008091752B2

(12) United States Patent
Jian et al.

(10) Patent No.: US 8,091,752 B2
(45) Date of Patent: Jan. 10, 2012

(54) NAIL GUN WITH A NAIL GUIDING UNIT

(75) Inventors: Jia-Liang Jian, Taichung Hsien (TW); Cheng-Hung Chiu, Taichung Hsien (TW)

(73) Assignee: Rexon Industrial Corp., Ltd., Taichung, Hsien (TW)

( * ) Notice: Subject to any disclaimer, the term of this patent is extended or adjusted under 35 U.S.C. 154(b) by 347 days.

(21) Appl. No.: 12/193,465

(22) Filed: Aug. 18, 2008

(65) Prior Publication Data

US 2009/0050665 A1 Feb. 26, 2009

(30) Foreign Application Priority Data

Aug. 21, 2007 (TW) ..... 96130891 A

(51) Int. Cl.
*B25C 1/00* (2006.01)

(52) U.S. Cl. ..... 227/120; 227/8; 227/119

(58) Field of Classification Search ..... 227/120, 227/123, 109, 119, 8, 140, 148
See application file for complete search history.

(56) References Cited

U.S. PATENT DOCUMENTS

| | | | | | |
|---|---|---|---|---|---|
| 1,962,874 | A * | 6/1934 | Polzer | 227/123 |
| 2,117,741 | A * | 5/1938 | Polzer | 227/109 |
| 2,117,743 | A * | 5/1938 | Polzer | 227/121 |
| 2,283,873 | A * | 5/1942 | Vogel | 227/123 |
| 2,300,277 | A * | 10/1942 | Hansen | 227/123 |
| 2,775,764 | A * | 1/1957 | Maynard | 227/123 |
| 2,853,707 | A * | 9/1958 | Juilfs | 227/123 |
| 3,840,165 | A * | 10/1974 | Howard | 227/1 |
| 4,467,952 | A * | 8/1984 | Morrell, Jr. | 227/123 |
| 4,688,710 | A * | 8/1987 | Massari et al. | 227/109 |
| 5,632,431 | A * | 5/1997 | Lin | 227/109 |
| 5,873,509 | A * | 2/1999 | Liao | 227/109 |
| 6,056,182 | A * | 5/2000 | Chen | 227/123 |
| 6,193,126 | B1 * | 2/2001 | Lee | 227/83 |
| 6,431,428 | B1 * | 8/2002 | Chen | 227/120 |
| 6,715,657 | B2 * | 4/2004 | Chen | 227/120 |
| 6,880,739 | B1 * | 4/2005 | Zhu | 227/109 |
| 6,938,813 | B1 * | 9/2005 | Chen | 227/120 |
| 7,000,817 | B1 * | 2/2006 | Wang | 227/109 |
| 7,025,242 | B1 * | 4/2006 | Schnell | 227/120 |
| 7,815,087 | B2 * | 10/2010 | Jian | 227/120 |
| 2004/0084499 | A1 * | 5/2004 | Tsai | 227/109 |
| 2006/0102683 | A1 * | 5/2006 | Schnell et al. | 227/119 |

* cited by examiner

*Primary Examiner* — Lindsay Low
(74) *Attorney, Agent, or Firm* — Stephen A. Bent; Foley & Lardner LLP

(57) ABSTRACT

A nail gun includes a body, a handle connected fixedly to and extending laterally from the body, a nail ejecting member disposed on the body and formed with a nail discharging passage having opposite inlet and outlet ends, a magazine member connected to the nail ejection member, and an elongated nail guiding plate disposed within the nail discharging passage, and a driving member. The nail guiding plate has a pivot end disposed pivotally within the inlet end of the nail discharging passage, a free end disposed within the outlet end of the nail discharging passage, and a driven portion disposed between the pivot end and the free end. The driving member is connected to the driven portion of the nail guiding plate for driving the free end of the nail guiding plate to pivot between first and second positions.

10 Claims, 15 Drawing Sheets

NAIL GUN WITH A NAIL GUIDING UNIT

CROSS-REFERENCE TO RELATED APPLICATION

This application claims priority of Taiwanese Application No. 096130891, filed on Aug. 21, 2007.

BACKGROUND OF THE INVENTION

1. Field of the Invention

This invention relates to a nail gun, and more particularly to a nail gun that includes an adjustable nail guiding plate.

2. Description of the Related Art

Referring to FIG. 1, a first conventional nail gun includes a body 1, a vertical nail ejection member 2, and a horizontal magazine member 4 for receiving a rectangular nail strip 5.

With reference to FIG. 2, a second conventional nail gun 1' includes a body 11, a nail ejection member 2', and an inclined magazine member 4' extending outwardly and upwardly from the nail ejection member 2' for receiving a parallelogram nail strip 5'.

To increase the flexibility to use in various working spaces, a pneumatic nail gun disclosed in U.S. Pat. No. 6,431,428 includes a body, a handle, and an adjustable magazine. The magazine is rotatable to a horizontal position and an inclined position relative to the body. Due to such angle adjustability of the magazine, nails are jammed easily within a nail discharging passage in the body. Thus, it is desirable to provide an adjustable nail guiding means in the nail discharging passage to allow for smooth movement of the nails from the magazine into the nail discharging passage.

SUMMARY OF THE INVENTION

The object of this invention is to provide a nail gun that includes an adjustable nail guiding plate disposed in a nail ejection member for facilitating smooth movement of nails within the nail gun.

According to this invention, a nail gun includes a body, a handle connected fixedly to and extending laterally from the body, a nail ejecting member disposed on the body and formed with a nail discharging passage having opposite inlet and outlet ends, a magazine member connected to the nail ejection member, and an elongated nail guiding plate disposed within the nail discharging passage, and a driving member. The nail guiding plate has a pivot end disposed pivotally within the inlet end of the nail discharging passage, a free end disposed within the outlet end of the nail discharging passage, and a driven portion disposed between the pivot end and the free end. The driving member is connected to the driven portion of the nail guiding plate for driving the free end of the nail guiding plate to pivot between first and second positions.

In one embodiment, the nail ejection member is disposed under the body, and extends along a vertical direction. The magazine member is pivotable relative to the nail ejection member between a horizontal position and an inclined position. The nail discharging passage has a proximate side proximate to the magazine member and a distal side distal from the magazine member. The driving member is rotatable relative to the nail ejection member such that, when the magazine member is disposed in the horizontal position, the free end of the nail guiding plate is disposed in the first position, and is spaced apart from the proximate side of the nail discharging passage by a first horizontal distance, and when the magazine member is disposed in the inclined position, the free end of the nail guiding is disposed in the second position, and is spaced apart from the proximate side of the nail discharging passage by a second horizontal distance larger than the first horizontal distance.

BRIEF DESCRIPTION OF THE DRAWINGS

These and other features and advantages of this invention will become apparent in the following detailed description of the preferred embodiments of this invention, with reference to the accompanying drawings, in which.

DETAILED DESCRIPTION OF THE PREFERRED EMBODIMENTS

Figure 1:
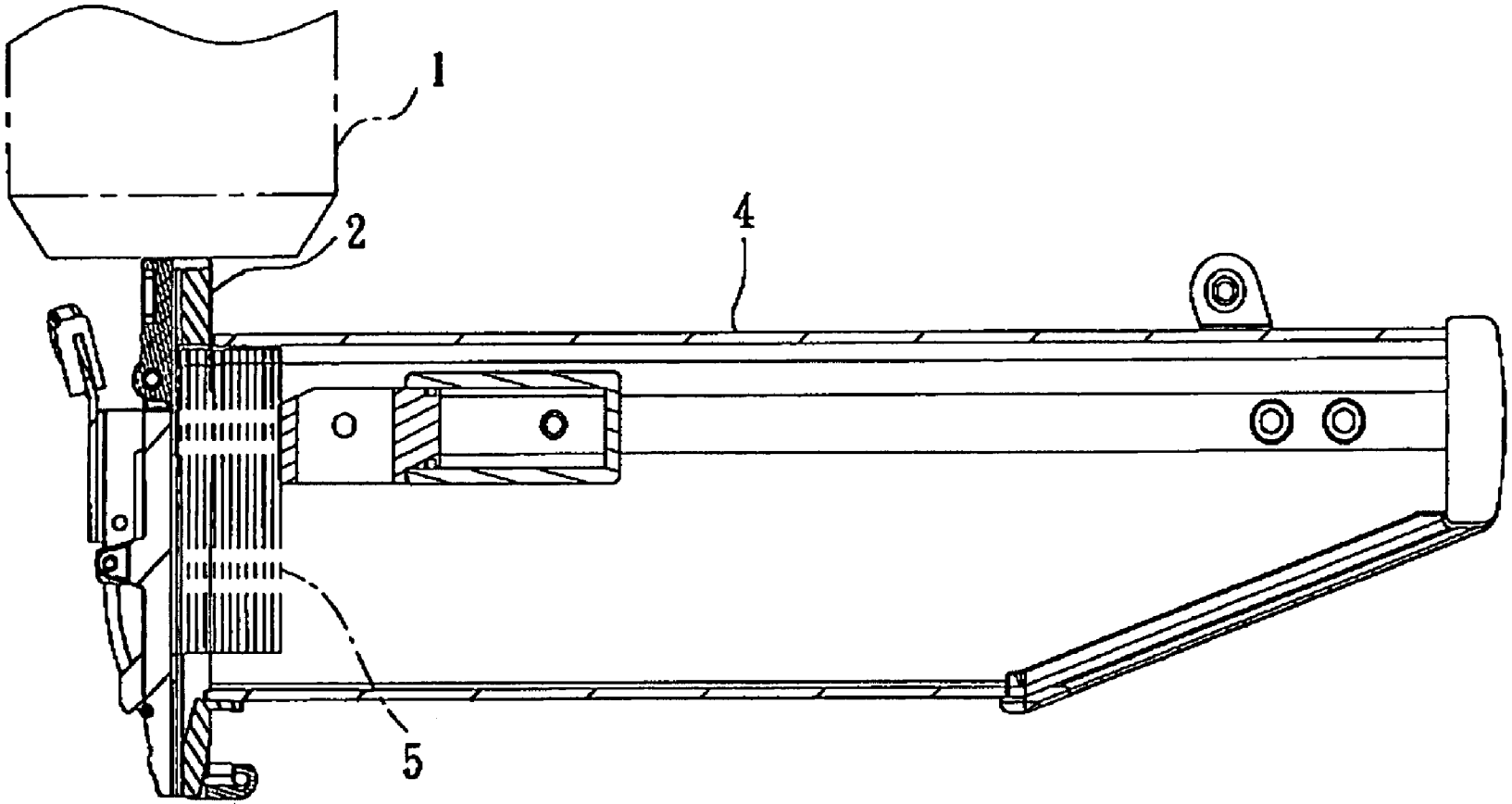
FIG. 1 PRIOR ART
FIG. 1 is a schematic side view of a first conventional nail gun.
Figure 2:
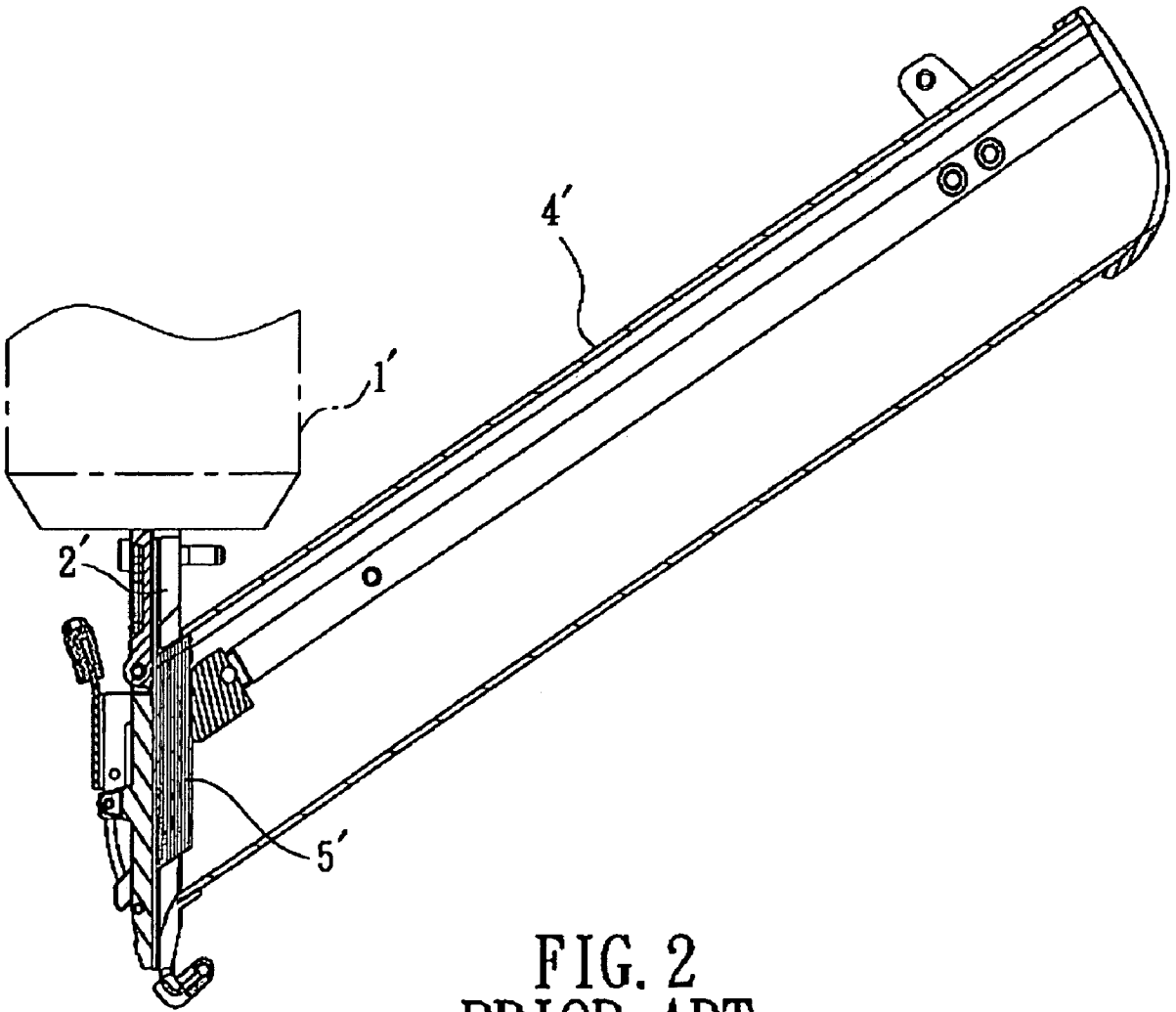
FIG. 2 PRIOR ART
FIG. 2 is a schematic side view of a second conventional nail gun.
Figure 3:
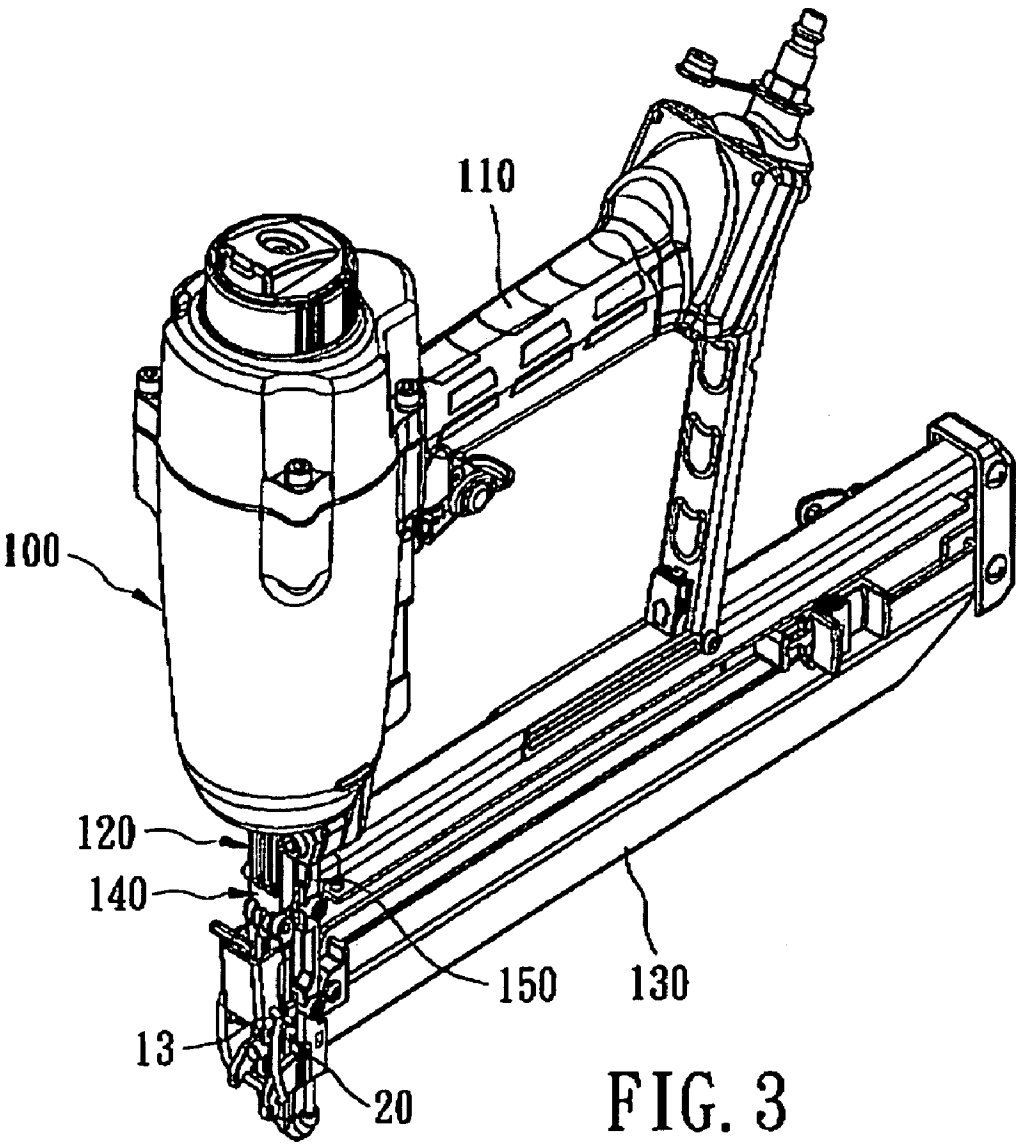
FIG. 3 is an assembled perspective view of the first preferred embodiment of a nail gun according to this invention.
Figure 4:
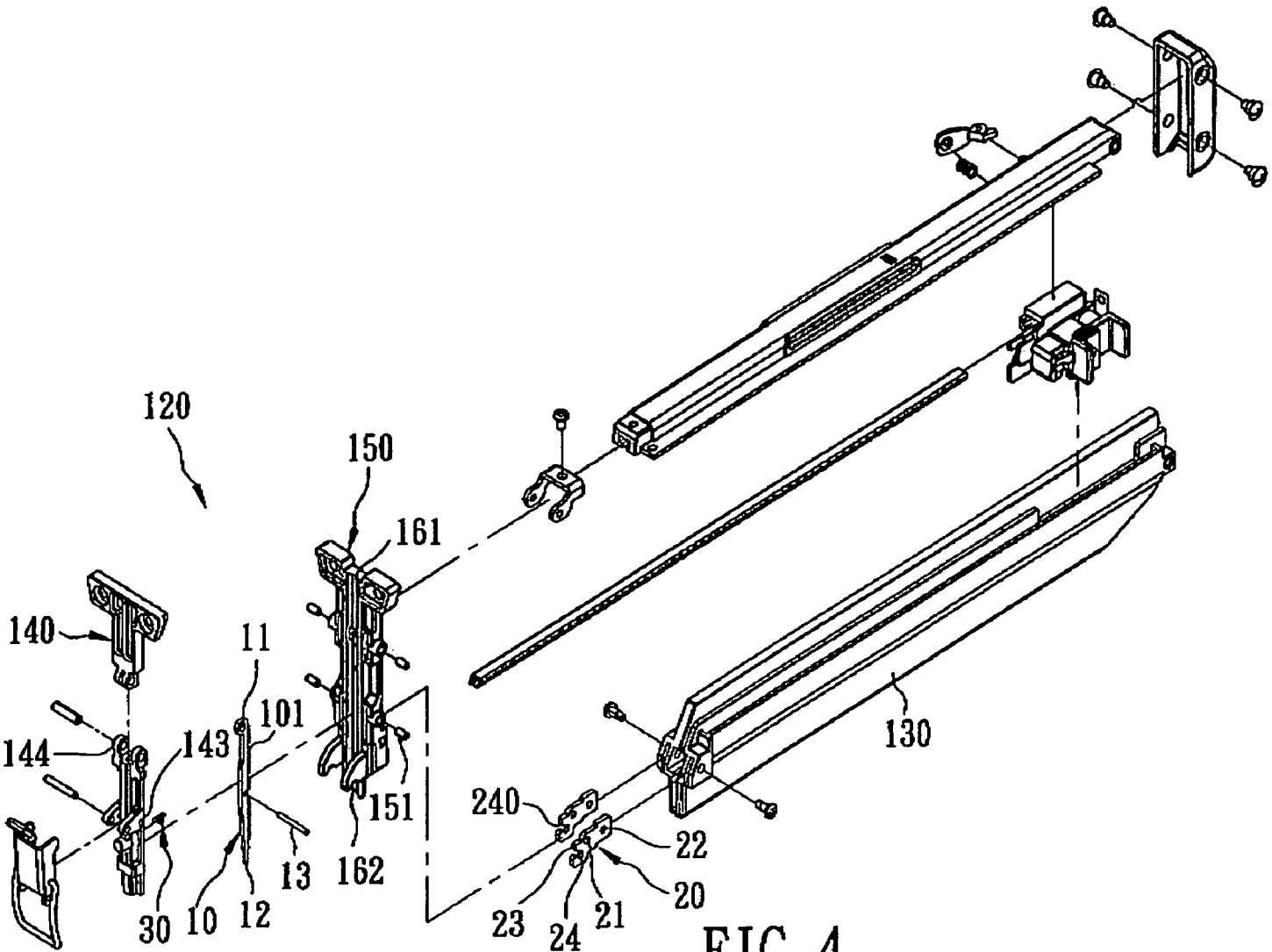
FIG. 4 is a fragmentary exploded perspective view of the first preferred embodiment.

In the following description, directional terms including "vertical", "upper", "lower", and other similar terms will be used to refer to the nail gun in a convenient orientation, in which the nail gun is shown in the drawings. It should be understood that this invention is not limited to any particular orientation.

Before the present invention is described in greater detail in connection with the preferred embodiments, it should be noted that similar elements and structures are designated by like reference numerals throughout the entire disclosure.

Referring to FIGS. 3, 4, 5, and 6, the first preferred embodiment of a nail gun according to this invention includes a body 100, a handle 110 connected fixedly to and extending laterally from the body 100, a nail ejecting member 120 disposed under and connected to the body 100 and extending along a vertical direction, an angle-adjustable magazine member 130 connected pivotally to the nail ejection member 120, and a nail guiding unit. The nail ejection member 120 includes a nail ejection plate 140, an intermediate plate 150, and a nail discharging passage 160 defined between the nail ejection plate 140 and the intermediate plate 150. The magazine member 130 is pivotable relative to the nail ejection member 120 between a horizontal position shown in FIGS. 3, 5, and 6, and an inclined position shown in FIGS. 7, 8, and 9. The nail ejection plate 140 has a horizontal slide slot 143, a pivot portion 144, and a cavity 145 in spatial communication with the nail discharging passage 160. The intermediate plate 150 includes a pivot pin unit 151 disposed fixedly thereon and aligned with the cavity 145. The nail discharging passage 160 has an inlet end 161 (i.e., upper end) disposed pivotally on the pivot portion 144, an outlet end 162 opposite to the inlet end 161 along the vertical direction, a proximate side 163 proximate to the magazine member 130, and a distal side 164 distal from the magazine member 130. In this embodiment, the nail guiding unit includes an elongated nail guiding plate 10, a driving member 20 for driving pivoting movement of the nail guiding plate 10, and a resilient member 30.

The nail guiding plate 10 is disposed within the nail discharging passage 160, and includes a plate body 101 having a pivot end 11 disposed pivotally within the inlet end 161 of the nail discharging passage 160, and a free end 12 disposed within the outlet end 162 of the nail discharging passage 160, and a driven portion 13 disposed between the pivot end 11 and the free end 12. The free end 12 of the nail guiding plate 10 is pivotable between a first position shown in FIGS. 5 and 6, and a second position shown in FIGS. 7 and 8. The driven portion 13 is configured as a pin connected fixedly to a middle portion of the plate body 101 and confined within and extending through the slide slot 143 along a transverse direction of the plate body 101. The slide slot 143 has a diameter larger than that of the driven portion 13, a left slot side 143A distal from the magazine member 130, and a right slot side 143B proximate to the magazine member 130.

In this embodiment, the driving member 20 is configured as two parallel plates each having an intermediate portion 21 sleeved rotatably on the pivot pin unit 151 of the intermediate plate 150, an anchor end 22 connected fixedly to the magazine member 130, a driving end 23 opposite to the anchor end 22 and formed with a groove 24, and a pushing face 241 defining a top end of an opening 240 of the groove 24. The openings 240 in the driving member 20 face the distal side 164 of the nail discharging passage 160. As such, the driving member 20 is co-rotatable with the magazine member 130 relative to the nail ejection member 120.

The resilient member 30 is configured as a coiled compression spring, and is disposed between the nail guiding plate 10 and the nail ejection member 120 for biasing the free end 12 of the nail guiding plate 10 toward the first position. In this embodiment, the resilient member 30 is disposed within the cavity 145 in the nail ejection plate 140.

Figure 5:
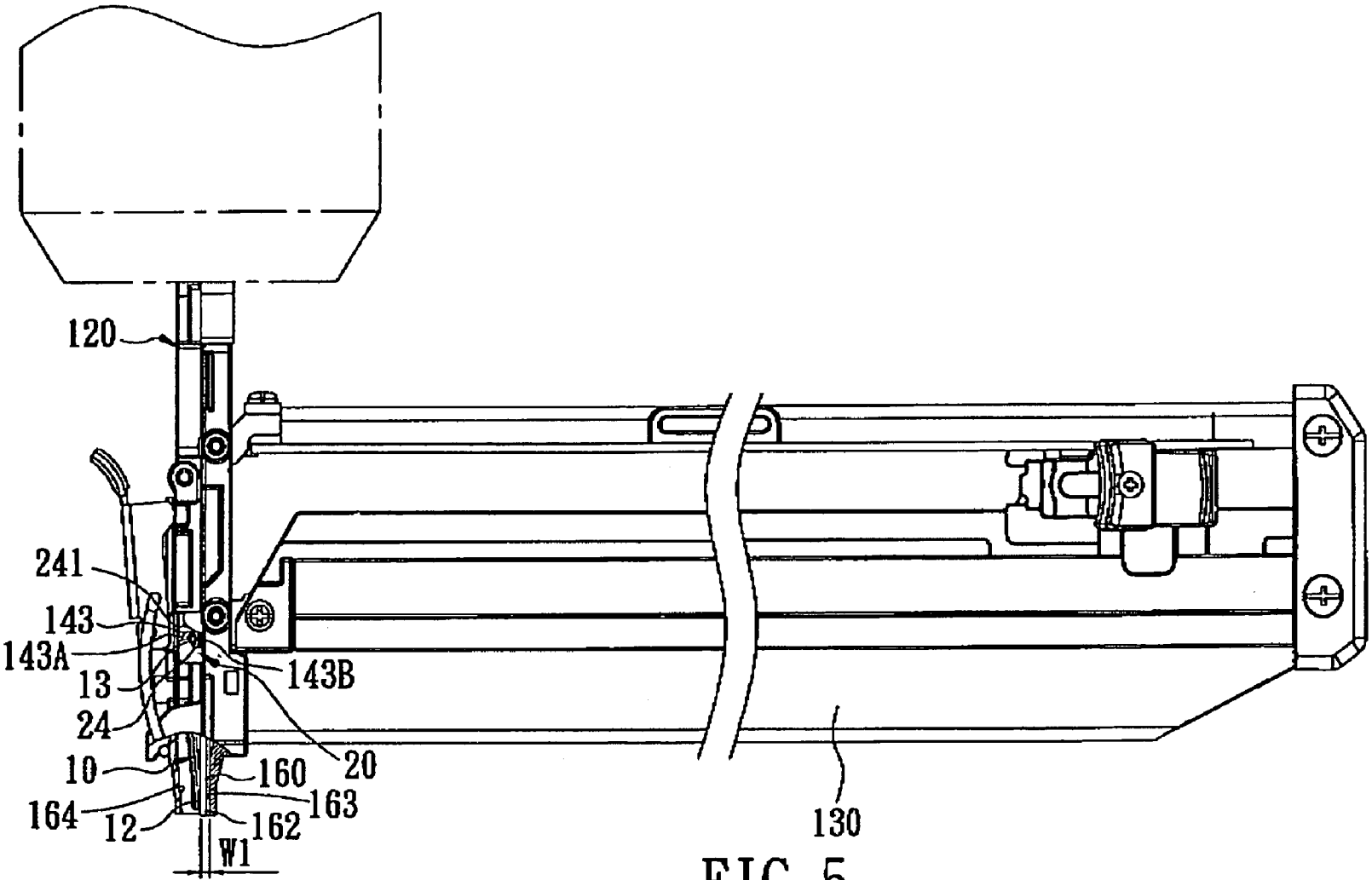
FIG. 5 is a fragmentary, partly sectional side view of the first preferred embodiment when a magazine member is disposed in a horizontal position so that a free end of a nail guiding plate is disposed in a first position.
Figure 6:
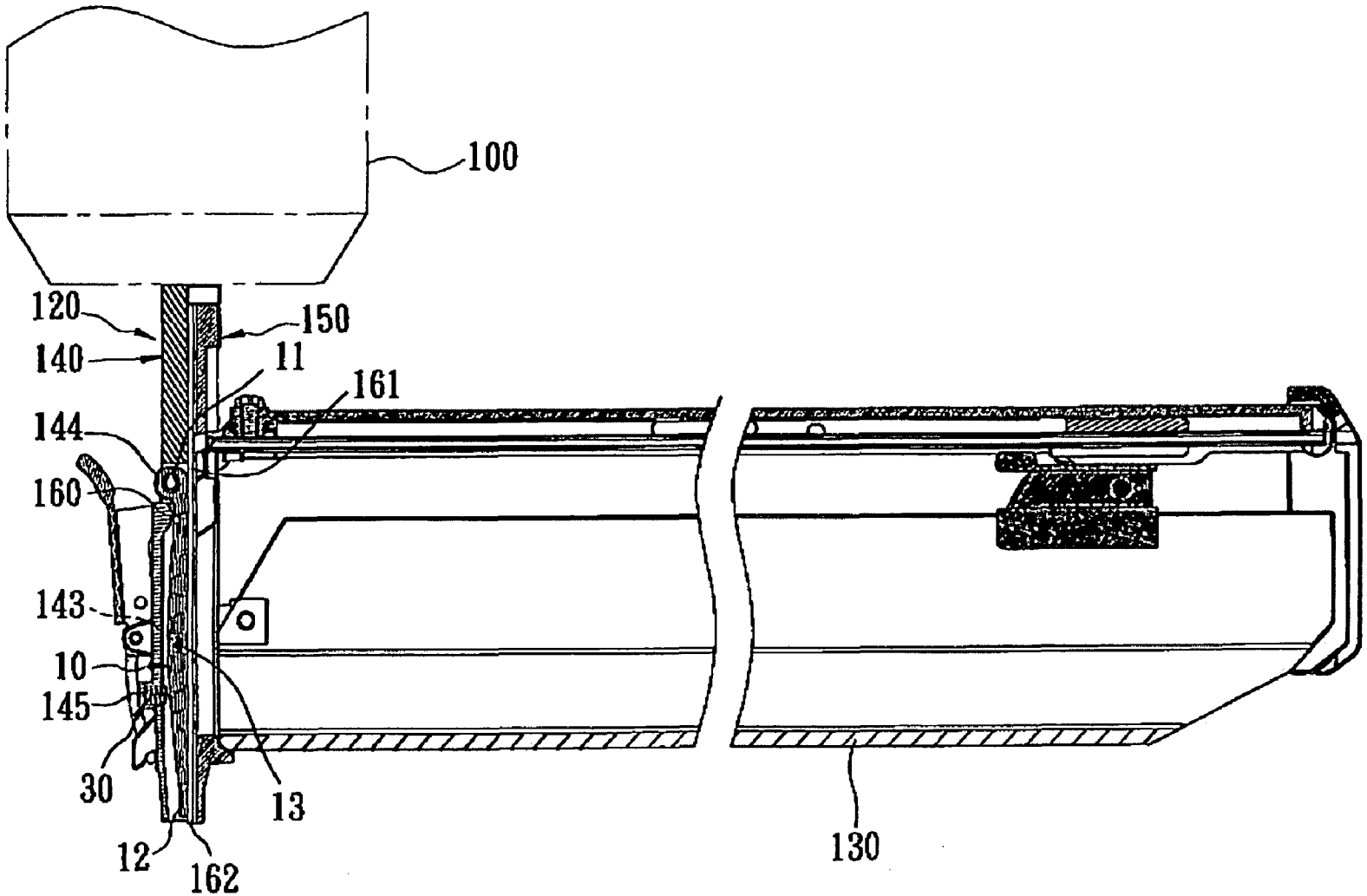
FIG. 6 is a fragmentary, partly sectional side view of the first preferred embodiment when the magazine member is disposed in the horizontal position, illustrating how the nail guiding plate is biased to pivot toward the magazine member by a resilient member so that a pin is disposed in a right slot side of a slide slot in a nail ejection plate.

With particular reference to FIGS. 5 and 6, when the magazine member 130 is disposed in the horizontal position, the driven portion 13 of the nail guiding plate 10 is disposed within the grooves 24 in the driving member 20 and the right slot side 143B of the slide slot 143 in the nail ejection plate 140 due to the biasing action of the resilient member 30. Hence, the free end 12 of the nail guiding plate 10 is disposed in the first position, and is spaced apart from the proximate side 163 of the nail discharging passage 160 by a first horizontal distance (W1) Due to the angle-adjustability of the nail guiding plate 10, nails can be moved smoothly from the magazine member 130 into the nail discharging passage 160. Thus, the object of this invention is achieved.

Figure 7:
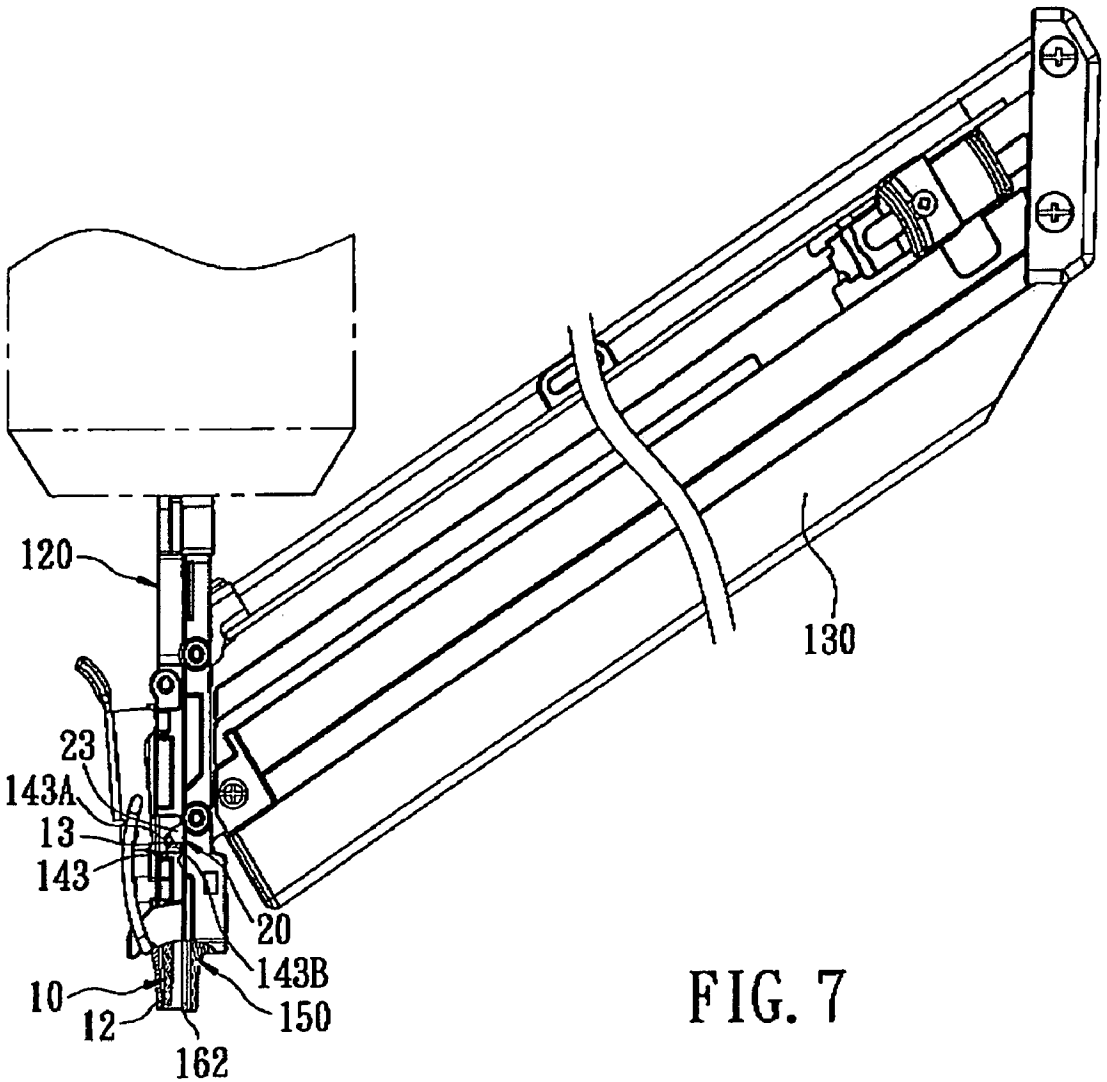
FIG. 7 is a fragmentary, partly sectional side view of the first preferred embodiment when the magazine member is disposed in an inclined position, illustrating how the pin is pushed to a left slot side of the slide slot by a driving member.
Figure 8:
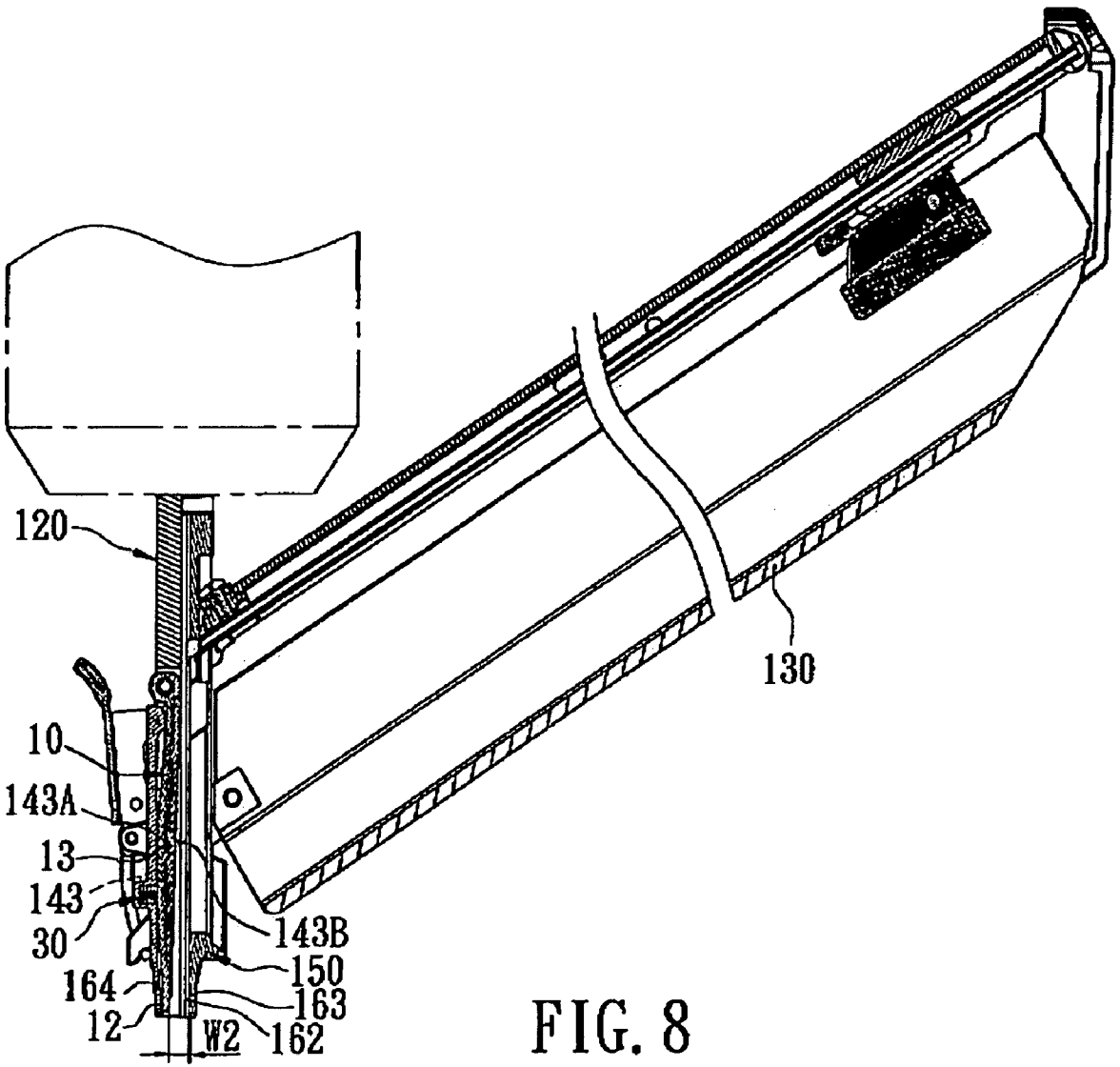
FIG. 8 is a fragmentary, partly sectional side view of the first preferred embodiment when the magazine member is disposed in the inclined position so that the free end of the nail guiding plate is disposed in a second position.
Figure 9:
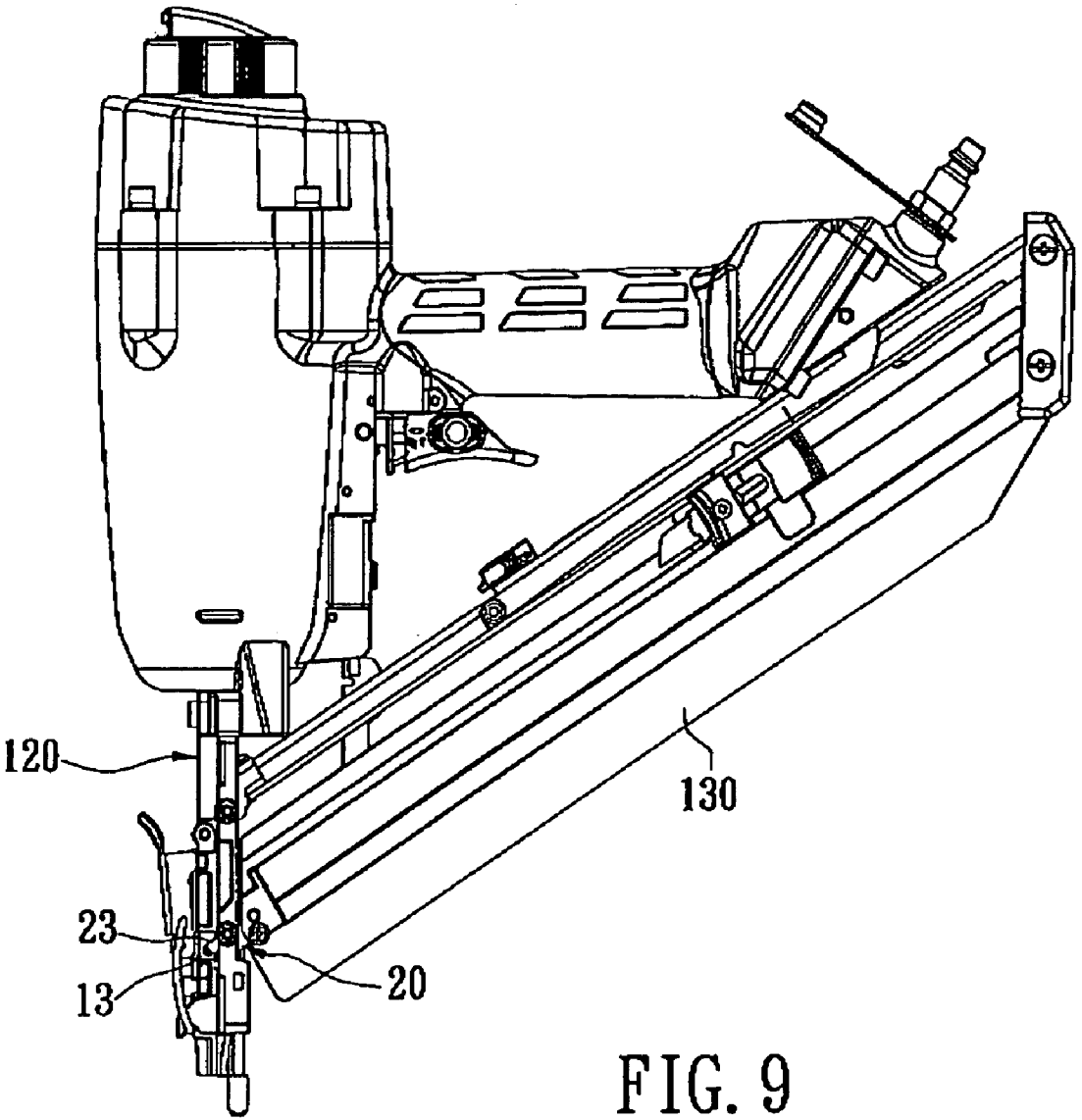
FIG. 9 is a fragmentary side view of the first preferred embodiment when the magazine member is disposed in the inclined position.

With particular reference to FIGS. 7 and 8, when the magazine member 130 is pivoted upwardly about the pivot pin unit 151 from the horizontal position to the inclined position, the driving member 20 pivots downwardly about the pivot pin unit 151 so that the pushing faces 241 of the driving member 20 push and pivot the driven portion 13 to the left slot side 143A of the slide slot 143 in the nail ejection plate 140. Hence, the free end 12 of the nail guiding plate 10 is pivoted to the second position, and is spaced apart from the proximate side 163 of the nail discharging passage 160 by a second horizontal distance (W2) that is larger than the first horizontal distance (W1).

In this embodiment, pivoting movement of the magazine member 130 about the pivot pin unit 151 between the horizontal position and the inclined position results in pivoting movement of the free end 12 of the nail guiding plate 10 about the pivot end 11 between the first and second positions, thereby resulting in convenience during use.

Figure 10:
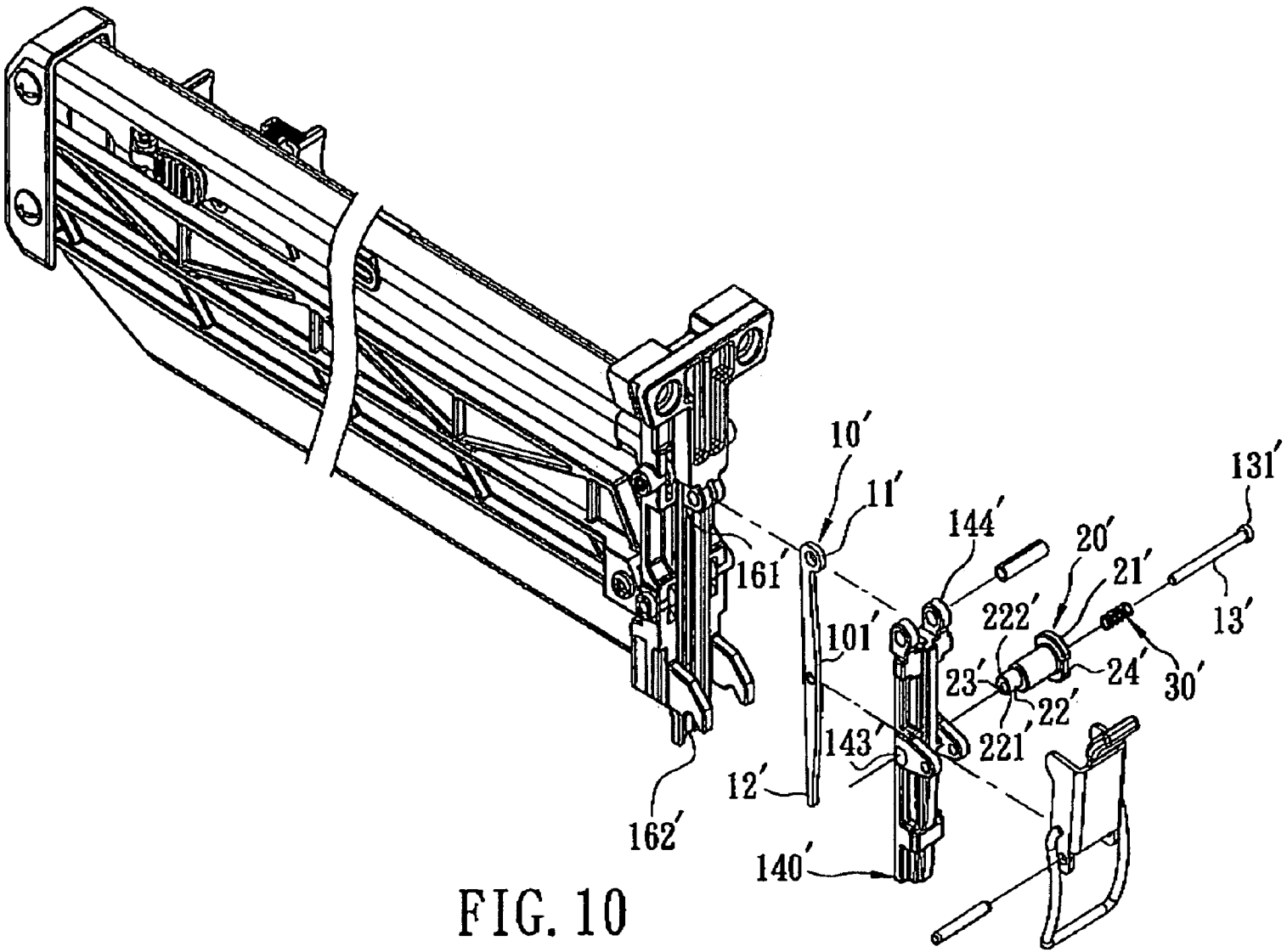
FIG. 10 is a partly exploded perspective view of the second preferred embodiment of a nail gun according to this invention.
Figure 11:
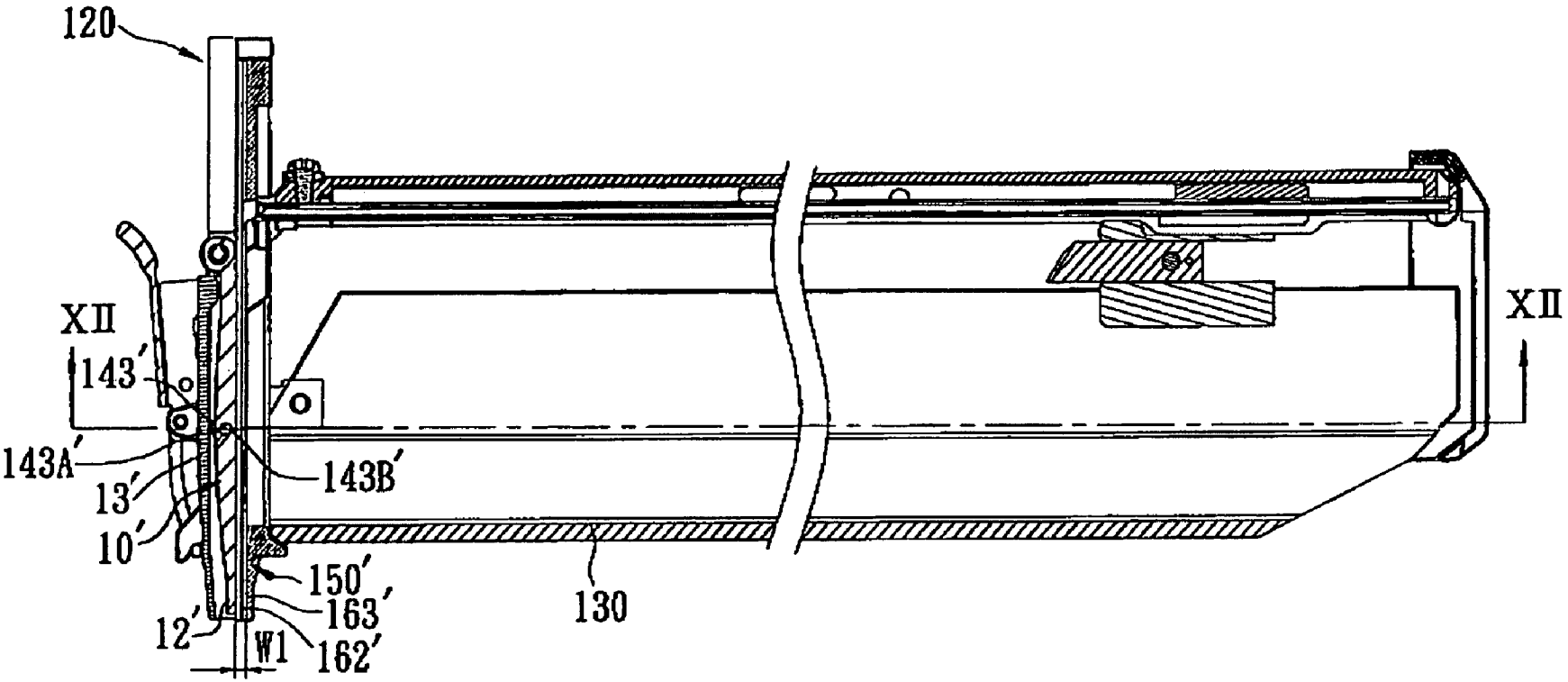
FIG. 11 is a fragmentary, partly sectional side view of the second preferred embodiment when a magazine member is disposed in a horizontal position so that a free end of a nail guiding plate is disposed in a first position.
Figure 12:
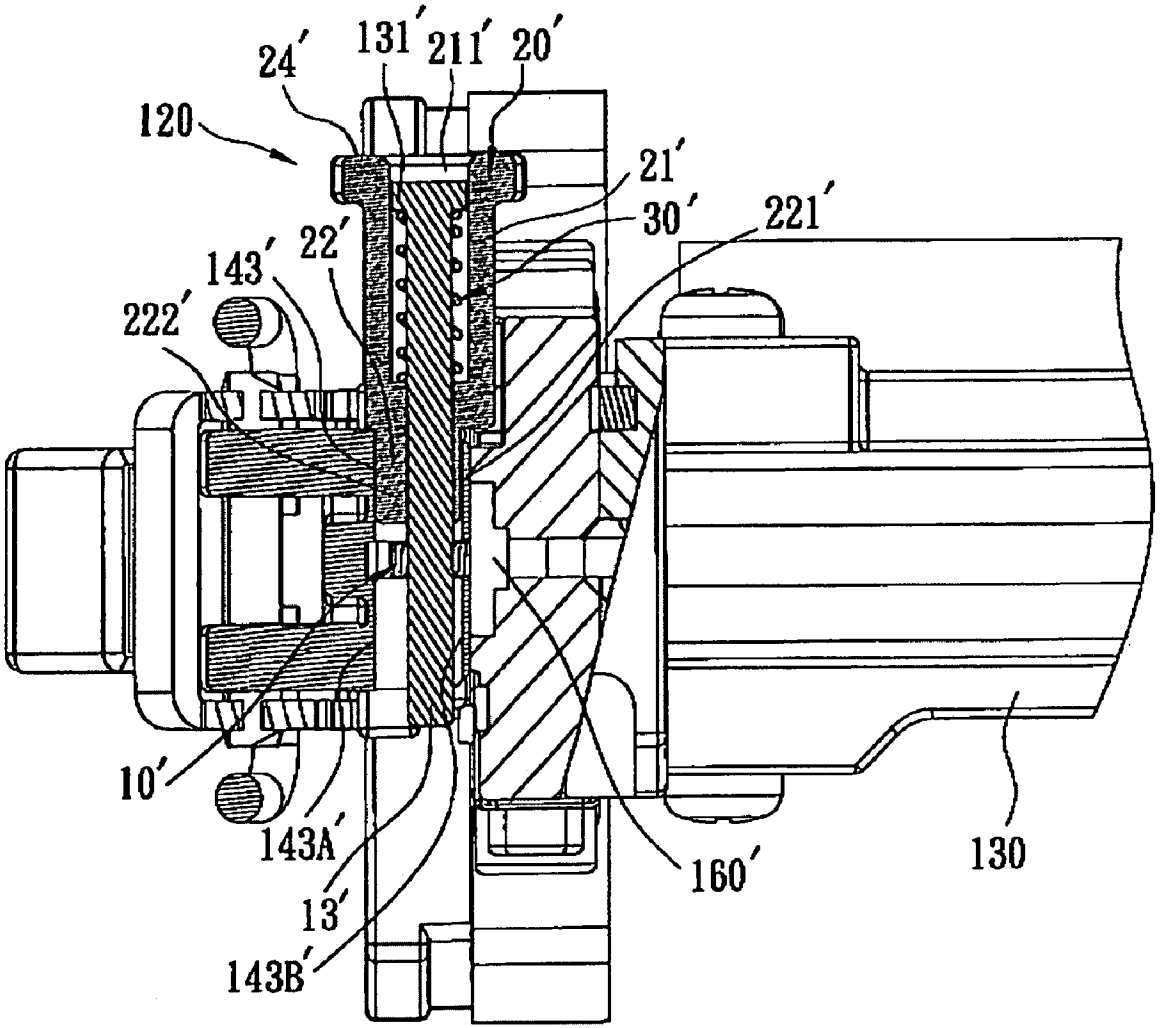
FIG. 12 is a sectional view taken along Line XII-XII in FIG. 11.

FIGS. 10, 11, and 12 show the second preferred embodiment of a nail gun according to this invention. In this embodiment, the nail guiding unit includes a nail guiding plate 10', a driving member 20' for driving pivoting movement of the nail guiding plate 10', and a coiled compression spring 30', and the nail ejection plate 140' has a horizontal slide slot 143' and a pivot portion 144'.

The nail guiding plate 10' is disposed within the nail discharging passage 160', and includes a plate body 101' having a pivot end 11' disposed pivotally on the pivot portion 144' of the nail ejection plate 140' and within the inlet end 161' of the nail discharging passage 160', and a free end 12' opposite to the pivot end 11' and disposed within the outlet end 162' of the nail discharging passage 160', and a driven portion 13' connected fixedly to a middle portion of the plate body 101' and disposed between the inlet and outlet ends 161', 162'. The driven portion 13' is configured as a pin confined within and extending through the slide slot 143' along a transverse direction of the plate body 101', and has an enlarged head 131' disposed outwardly of the nail ejection plate 140'. The diameter of the slide slot 143' is larger than that of the driven portion 13' so as to allow the driven portion 13' to move transversely within the slide slot 143'. The driving member 20' has a hollow outer cylindrical portion 21', a hollow inner cylindrical portion 22' formed with an eccentric hole 23', and an outward flange 24'. The inner cylindrical portion 22' is disposed fittingly and rotatably within an upper end of the slide slot 143'. The driven portion 13' extends fittingly through the eccentric hole 23' in the inner cylindrical portion 22'. As such, when the driving member 20' is rotated, the driven portion 13' moves within the slide slot 143'. The outer cylindrical portion 21' has a lower end connected eccentrically to an upper end of the inner cylindrical portion 22', an upper end exposed outwardly of the nail ejection member 120 and operable to rotate the inner cylindrical portion 22' within the slide slot 143', and an outer diameter larger than that of the inner cylindrical portion 22'. The outward flange 24' extends radially and outwardly from the upper end of the outer cylindrical portion 21' so as to allow for convenient upward pulling of the driving member 20'. The head 131' of the driven portion 13' is disposed within the outer cylindrical portion 21' of the driving member 20'. The driving member 20' further has a bolt 211' (see FIG. 12) that is threaded in the upper end of the outer cylindrical portion 21' to constitute an upper end wall of the outer cylindrical portion 21' for confining the head 131' of the driven portion 13' between the bolt 211' and a lower end wall of the outer cylindrical portion 21'. The coiled compression spring 20' is sleeved on the driven portion 13' between the head 131' of the driven portion 13' and the lower end wall of the outer cylindrical portion 21' for biasing the head 131' of the driven portion 13' to abut against the bolt 211', as shown in FIG. 12.

When it is desired to use the nail gun in such a manner that the magazine member 130 is disposed in a horizontal position shown in FIG. 11, the driving member 20' is rotated to a first angular position shown in FIG. 12. In the first angular position, the thinnest portion 221' of the inner cylindrical portion 22' of the driving member 20' is disposed between the driven portion 13' and the magazine member 130, and the driven portion 13' is disposed in a right slot side 143B' of the slide slot 143'. As such, the free end 12' of the nail guiding plate 10' is disposed in a first position, and is spaced apart from the proximate side 163 of the nail discharging passage 160' by a first horizontal distance (W1), as shown in FIG. 11.

Figure 13:
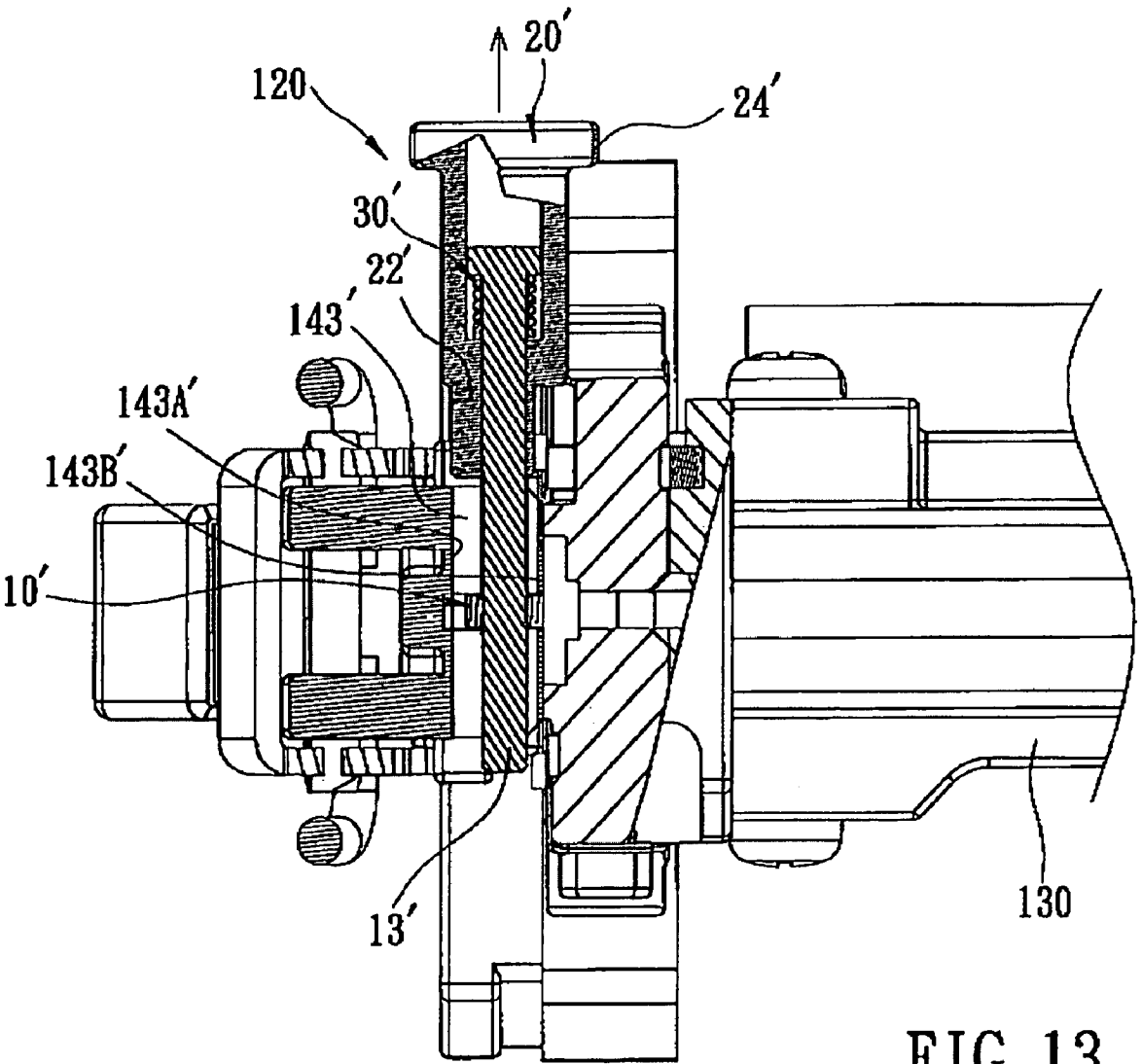
FIGS. 13 and 14 are fragmentary, schematic partly sectional views of the second preferred embodiment, illustrating operation of a driving member.
Figure 14:
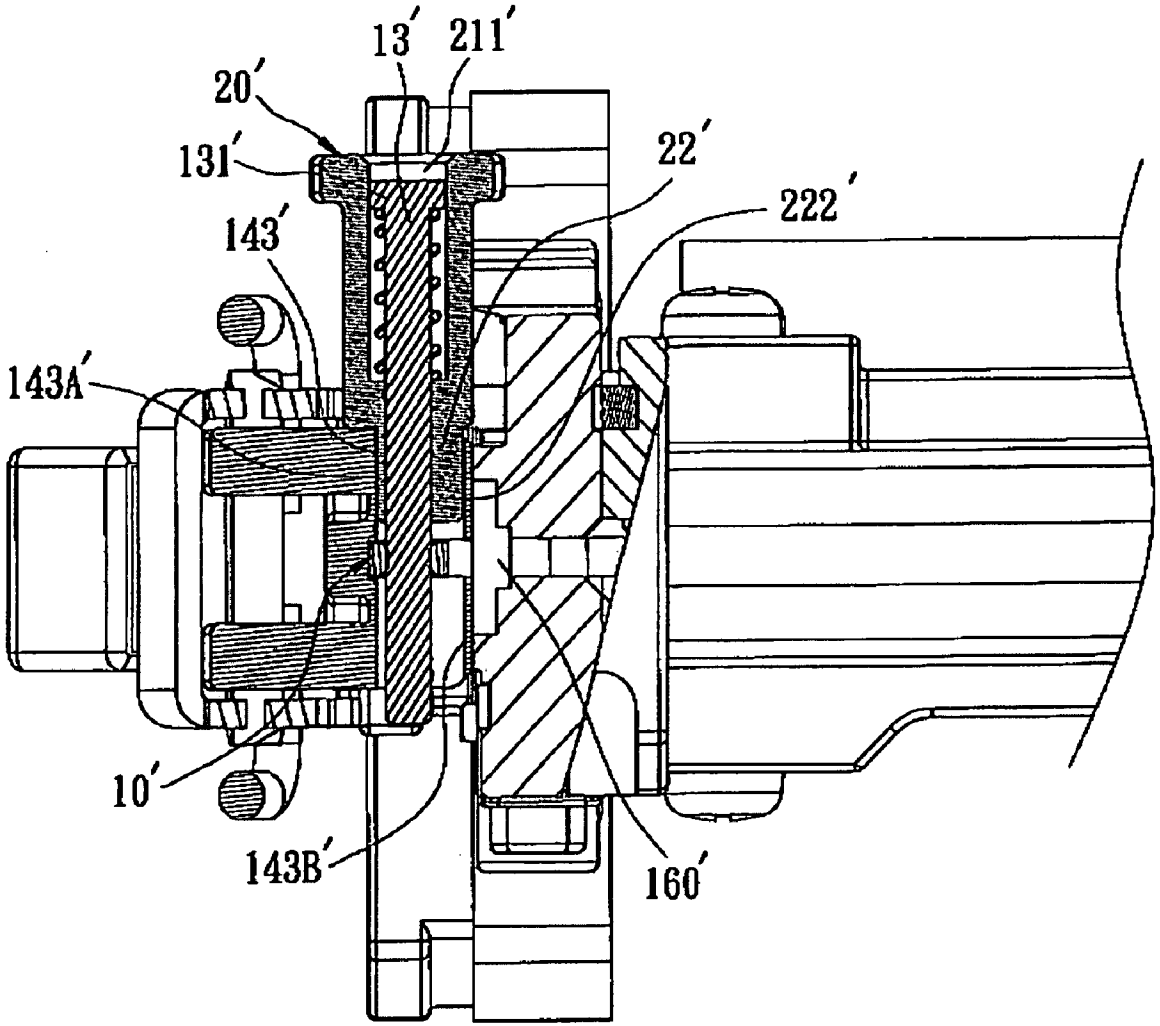
Figure 15:
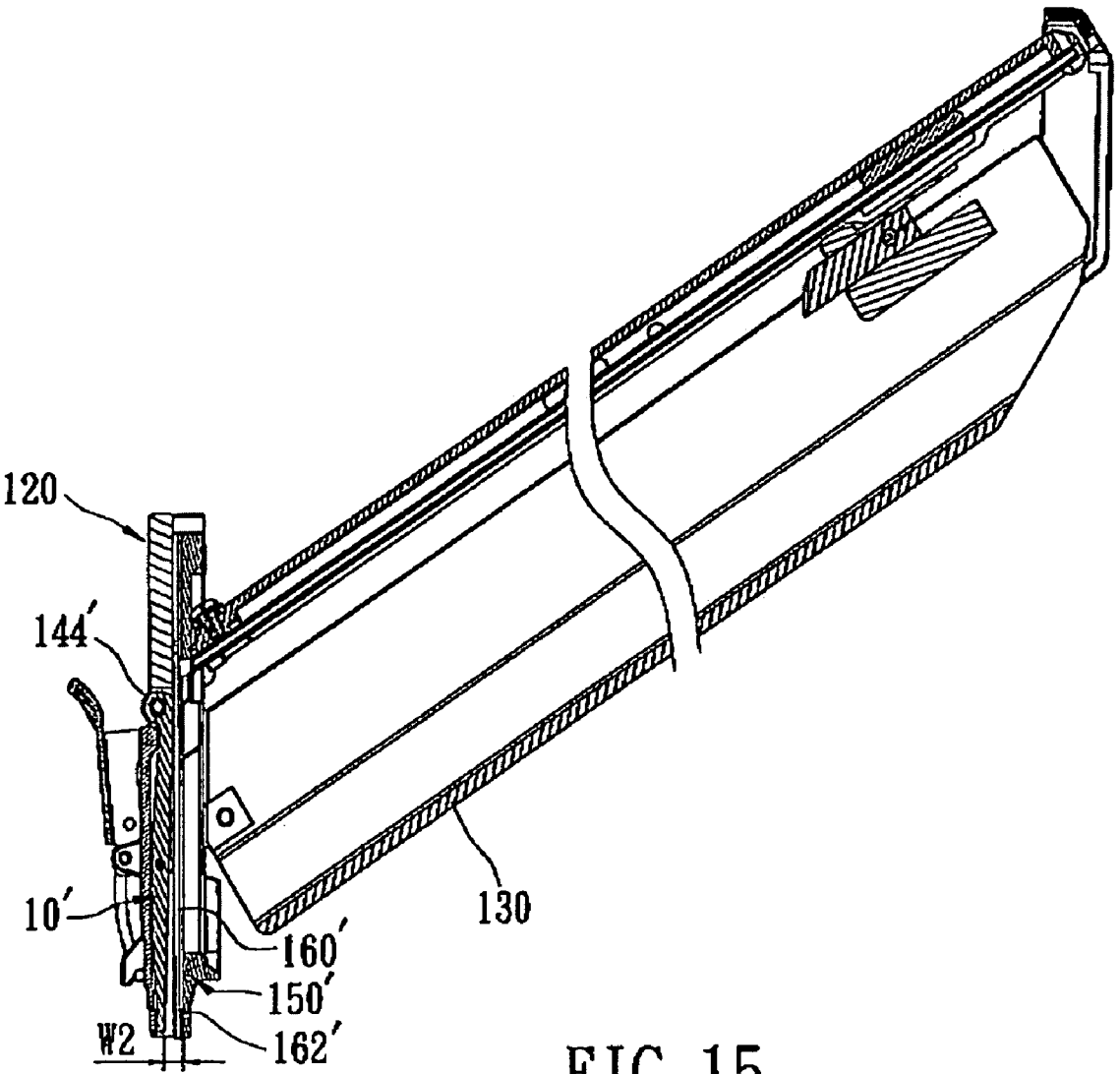
FIG. 15 is a fragmentary, partly sectional view of the second preferred embodiment when the magazine member is disposed in an inclined position so that the free end of the nail guiding plate is disposed in a second position.

When it is desired to use the nail gun in such a manner that the magazine member 130 is disposed in an inclined position shown in FIG. 15, the outward flange 24' of the driving member 20' is first pulled upwardly away from the driven portion 13' such that the coiled compression spring 30' is compressed, as shown in FIG. 13. Next, the driving member 20' is rotated by 180 degrees, and is then released. Hence, the driving member 20' is biased by the coiled compression spring 30' to move downwardly toward the driven portion 13' until it is moved to a second angular position shown in FIG. 14 so that the bolt 211' abuts against the head 131' of the driven portion 13'. In the second angular position, the thickest portion 222' of the inner cylindrical portion 22' of the driving member 20' is disposed between the driven portion 13' and the magazine member 130, and the driven portion 13' is disposed in a left slot side 143A' of the slide slot 143'. As such, the free end 12' of the nail guiding plate 10' is disposed in a second position, and is spaced apart from the proximate side 163 of the nail discharging passage 160' by a second horizontal distance (W2), as shown in FIG. 15.

In this embodiment, to pivot the free end 12' of the nail guiding plate 10' between the first and second positions, it is necessary to operate manually the driving member 20.

With this invention thus explained, it is apparent that numerous modifications and variations can be made without departing from the scope and spirit of this invention. It is therefore intended that this invention be limited only as indicated by the appended claims.

We claim:

1. A nail gun comprising:

a body;

a handle connected fixedly to and extending laterally from said body;

a nail ejecting member disposed on said body and formed with a nail discharging passage having opposite inlet and outlet ends;

a magazine member connected to said nail ejection member; and a nail guiding unit including:

an elongated nail guiding plate disposed within said nail discharging passage and including a pivot end disposed pivotally within said inlet end of said nail discharging passage, a free end disposed within said outlet end of said nail discharging passage, and a driven portion disposed between said pivot end and said free end, and a driving member connected to said driven portion of said nail guiding plate for driving said free end of said nail guiding plate to pivot between first and second positions, wherein said nail ejection member is disposed under said body, and extends along a vertical direction, said magazine member is pivotable relative to said nail ejection member between a horizontal position and an inclined position, and said driving member is co-rotatable with said magazine member relative to said nail ejection member such that, when said magazine member is disposed in said horizontal position, said free end of said nail guiding plate is disposed in said first position, and when said magazine member is disposed in said inclined position, said free end of said nail guiding plate is disposed in said second position.

2. The nail gun as claimed in claim 1, wherein:

said nail discharging passage has a proximate side proximate to said magazine member and a distal side distal from said magazine member;

when said magazine member is disposed in said horizontal position, said free end of said nail guiding plate is spaced apart from said proximate side of said nail discharging passage by a first horizontal distance; and when said magazine member is disposed in said inclined position, said free end of said nail guiding plate is spaced apart from said proximate side of said nail discharging passage by a second horizontal distance larger than said first horizontal distance.

3. The nail gun as claimed in claim 1, wherein said nail guiding unit further includes a resilient member disposed between said nail guiding plate and said nail ejection member for biasing said free end of said nail guiding plate to pivot toward said first position.

4. The nail gun as claimed in claim 3, wherein said driving member has an intermediate portion disposed pivotally on said nail ejection member, an anchor end connected fixedly to said magazine member, and a driving end opposite to said anchor end and connected to said driven portion of said nail guiding plate.

5. The nail gun as claimed in claim 4, wherein said driving end of said driving member is formed with a groove, said driven portion of said nail guiding plate being disposed within said groove when said free end of said nail guiding plate is disposed in said first position.

6. The nail gun as claimed in claim 5, wherein said groove in said driving end of said driving member has an opening facing said distal side of said nail discharging passage, said nail guiding plate further including a plate body, said plate body having said pivot end and said free end, said driven portion of said nail guiding plate being configured as a pin connected fixedly to said plate body and extending along a transverse direction of said plate body, said driving end of said driving member being further formed with a pushing face defining a top end of said opening and shaped such that, when said magazine member is pivoted from said horizontal position to said inclined position, said pushing face pushes and pivots said pin toward said distal side of said nail discharging passage.

7. The nail gun as claimed in claim 6, wherein said nail ejection member is further formed with a horizontal slide slot having a diameter larger than that of said pin, said pin being confined within said slide slot.

8. The nail gun as claimed in claim 1, wherein:

said nail guiding plate further includes a plate body, said driven portion of said nail guiding plate being configured as a pin connected fixedly to said plate body and extending along a transverse direction of said plate body;

said nail ejection member is further formed with a horizontal slide slot having a diameter larger than that of said pin, said pin being confined within said slide slot; and said driving member has a hollow inner cylindrical portion disposed fittingly and rotatably within an upper end of said slide slot and formed with an eccentric hole, said pin extending fittingly through said eccentric hole in said inner cylindrical portion, said driving member being rotatable to move said pin within said slide slot.

9. The nail gun as claimed in claim 8, wherein said driving member further has a hollow outer cylindrical portion having a lower end connected eccentrically to an upper end of said inner cylindrical portion, an upper end exposed outwardly of said nail ejection member and operable to rotate said inner cylindrical portion within said slide slot, and an outer diameter larger than that of said inner cylindrical portion.

10. The nail gun as claimed in claim 9, wherein said pin has a head disposed within said outer cylindrical portion of said driving member, said outer cylindrical portion having opposite upper and lower end walls, said nail gun further comprising a coiled compression spring sleeved on said pin between said head of said pin and said lower end wall of said outer cylindrical portion of said driving member for biasing said head of said pin to abut against said upper end wall.

* * * * *